US011518478B2

(12) United States Patent
Waters et al.

(10) Patent No.: US 11,518,478 B2
(45) Date of Patent: Dec. 6, 2022

(54) BOAT HAVING A REMOVABLE SEAT POSITIONED OVER A WALKWAY ACCESSING AN EXPANDABLE DECK

(71) Applicant: MasterCraft Boat Company, LLC, Vonore, TN (US)

(72) Inventors: Nick P. Waters, Lenoir City, TN (US); David F. Ekern, Knoxville, TN (US); Paul M. Harrison, Vonore, TN (US); Chadrick E. Curts, Lenoir City, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 122 days.

(21) Appl. No.: 17/174,558

(22) Filed: Feb. 12, 2021

(65) Prior Publication Data

US 2021/0245838 A1 Aug. 12, 2021

Related U.S. Application Data

(60) Provisional application No. 62/975,456, filed on Feb. 12, 2020.

(51) Int. Cl.
*B63B 7/04* (2020.01)
*B63B 1/04* (2006.01)
(Continued)

(52) U.S. Cl.
CPC ..... *B63B 7/04* (2013.01); *B63B 1/04* (2013.01); *B63B 3/48* (2013.01); *B63B 29/04* (2013.01);
(Continued)

(58) Field of Classification Search
CPC .. B63B 7/04; B63B 1/04; B63B 29/04; B63B 3/48; B63B 2029/043; B63B 2003/485
See application file for complete search history.

(56) References Cited

U.S. PATENT DOCUMENTS 5,915,328 A * 6/1999 Rowan ..... B63B 27/146 441/80
D429,682 S 8/2000 Garland et al.
(Continued)

FOREIGN PATENT DOCUMENTS

KR 2009-0051024 A 5/2009
WO 96/28339 A1 9/1996
(Continued)

OTHER PUBLICATIONS

2020 Solaris Power 48 Open Luxury Yacht—Walkaround Tour—Debut at 2020 Boot Dusseldorf—YouTube, Jan. 27, 2020, available at https://www.youtube.com/watch?v=3sFtlZrCclg.
(Continued)

*Primary Examiner* — S. Joseph Morano
*Assistant Examiner* — Jovon E Hayes
(74) *Attorney, Agent, or Firm* — Venable LLP

(57) ABSTRACT

A boat in which at least a portion of at least one of the port side and the starboard side of the hull is moveable between a first position and a second position. In the first position the moveable portion forms a generally upright portion of the port or starboard side of the hull, and, in the second position, the moveable portion forms a generally horizontal deck surface. A walkway connects a seating area within the boat to an area aft of the seating area, and at least a portion of the walkway is adjacent to the moveable portion of the port or starboard side. A first seat is positioned adjacent to at least a portion of the walkway and a removable seat is configured to be positioned over the walkway and adjacent to the first seat.

19 Claims, 8 Drawing Sheets

(51) Int. Cl.
*B63B 29/04* (2006.01)
*B63B 3/48* (2006.01)

(52) U.S. Cl.
CPC ... *B63B 2003/485* (2013.01); *B63B 2029/043* (2013.01)

(56) References Cited

U.S. PATENT DOCUMENTS

| | | | | |
|---|---|---|---|---|
| 6,647,916 | B2 | 11/2003 | Neese et al. | |
| 6,766,758 | B1 | 7/2004 | Zoss et al. | |
| 6,786,170 | B2 | 9/2004 | Trowbridge | |
| 6,860,221 | B1 | 3/2005 | Henderson | |
| 6,899,169 | B1 | 5/2005 | Cox | |
| 7,004,101 | B1 * | 2/2006 | Mardikian | B63B 43/14 114/362 |
| 7,631,612 | B2 | 12/2009 | Aubert et al. | |
| 7,634,971 | B2 | 12/2009 | Lucas | |
| 7,900,574 | B2 | 3/2011 | Henricson | |
| 8,056,496 | B1 | 11/2011 | Bussa | |
| 8,752,499 | B2 * | 6/2014 | De Basto | B63B 17/04 114/364 |
| 8,800,470 | B1 | 8/2014 | Cummings | |
| 9,032,895 | B2 | 5/2015 | Buck | |
| 9,067,646 | B2 | 6/2015 | Admire | |
| 9,085,347 | B2 | 7/2015 | Antonelli | |
| 9,120,540 | B1 | 9/2015 | Foss et al. | |
| 9,156,526 | B2 | 10/2015 | Handley | |
| 9,193,417 | B2 | 11/2015 | De Basto et al. | |
| 9,302,740 | B2 | 4/2016 | O'Neal et al. | |
| 9,334,023 | B2 | 5/2016 | Admire | |
| 9,611,008 | B1 | 4/2017 | O'Neal et al. | |
| 9,676,449 | B1 * | 6/2017 | Syryda | B63B 1/14 |
| 9,845,135 | B2 | 12/2017 | Handley | |
| 9,896,165 | B2 * | 2/2018 | Neese | B63B 29/04 |
| 9,944,354 | B1 | 4/2018 | O'Neal et al. | |
| 10,017,235 | B2 | 7/2018 | Pappas et al. | |
| 10,106,227 | B2 * | 10/2018 | Allender | B63B 17/04 |
| 10,843,771 | B2 * | 11/2020 | Thomas | B63B 7/02 |
| 10,922,045 | B2 | 2/2021 | Sheedy et al. | |
| 11,186,346 | B2 * | 11/2021 | Overbye | B63B 34/70 |
| 2002/0033127 | A1 | 3/2002 | Barrett | |
| 2004/0154514 | A1 | 8/2004 | Burg | |
| 2005/0172881 | A1 | 8/2005 | Alvarez-Calderon | |
| 2005/0268838 | A1 | 12/2005 | Hinderberger | |
| 2007/0107646 | A1 | 5/2007 | Alvarez-Calderon | |
| 2007/0137541 | A1 | 6/2007 | Linsley | |
| 2013/0160695 | A1 | 6/2013 | Gratz et al. | |
| 2015/0291258 | A1 | 10/2015 | Hostetter et al. | |
| 2018/0065710 | A1 | 3/2018 | Handley | |
| 2018/0093741 | A1 | 4/2018 | Van Diepen | |
| 2018/0099726 | A1 | 4/2018 | Broadway et al. | |
| 2019/0054983 | A1 | 2/2019 | Barwick | |
| 2020/0001949 | A1 | 1/2020 | Williams et al. | |

FOREIGN PATENT DOCUMENTS

| | | | |
|---|---|---|---|
| WO | 2005/077745 | A1 | 8/2005 |
| WO | 2006/037663 | A1 | 4/2006 |
| WO | 2007/095535 | A3 | 8/2007 |
| WO | 2008/018829 | A1 | 2/2008 |
| WO | 2008/034955 | A1 | 3/2008 |
| WO | 2011/012895 | A1 | 2/2011 |
| WO | 2012/010545 | A1 | 1/2012 |
| WO | 2013/036940 | A1 | 3/2013 |
| WO | 2017/127891 | A1 | 8/2017 |
| WO | 2018/014112 | A1 | 1/2018 |

OTHER PUBLICATIONS

Jump Seat—Modification & Accessories—TheMalibuCrew.com, https://www.themalibucrew.com/index.php2/forums/topic/47296-jump-seat/& (last visited Jan. 31, 2020).

Sea Ray 400SLX—YouTube, Apr. 2, 2019, https://www.youtube.com/watch?v=qFWLBy7RQCg.

39 Coupe, Tiara Yachts, Jan. 29, 2020, www.tiarayachts.com/39-coupe/ (last visited Jan. 29, 2020).

* cited by examiner

BOAT HAVING A REMOVABLE SEAT POSITIONED OVER A WALKWAY ACCESSING AN EXPANDABLE DECK

CROSS-REFERENCE TO RELATED APPLICATIONS

This application claims the benefit under 35 U.S.C. § 119(e) of U.S. Provisional Patent Application No. 62/975,456, filed Feb. 12, 2020, and titled "A BOAT HAVING A REMOVABLE SEAT POSITIONED OVER A WALKWAY ACCESSING AN EXPANDABLE DECK," the entirety of which is incorporated herein by reference.

FIELD OF THE INVENTION

The invention relates to a boat, particularly a boat having an expandable deck, a walkway accessing the expandable deck, and a removable seat positioned over the walkway.

BACKGROUND OF THE INVENTION

In recreational boating, people enjoy the water and thus use the boat in many different ways. The boat may be driven on the body of water, and people may also enjoy activities on the boat when the boat is stationary, such as docked or anchored. When the boat is stationary, the activity may switch from being focused within the cockpit of the boat to water activities off the stern of the boat. A versatile boat having features that enhance the various water activities for which the boat is used is thus desired.

SUMMARY OF THE INVENTION

In one aspect, the invention relates to a boat including a hull, a seating area within the boat, a walkway connecting the seating area within the boat to an area aft of the seating area, a first seat within the seating area, and a removable seat. The hull includes a bow, a transom, a port side, and a starboard side. At least a portion of at least one of the port side and the starboard side of the hull is moveable between a first position and a second position. In the first position, the moveable portion forms a generally upright portion of the port or starboard side of the hull, and in the second position, the moveable portion forms a generally horizontal deck surface that is configured to support a human weighing at least one hundred pounds. At least a portion of the walkway is adjacent to the moveable portion of the port or starboard side, and the first seat is positioned adjacent to at least a portion of the walkway. The removable seat is configured to be positioned over the walkway and adjacent to the first seat.

In another aspect, the invention relates to a boat including a hull, a primary seating area within the boat, a port walkway connecting the primary seating area to an area aft of the primary seating area, a starboard walkway connecting the primary seating area to the area aft of the primary seating area, and a removable seat. The hull includes a bow, a transom, a port side, and a starboard side. At least a portion of the port side of the hull is moveable between a first position and a second position. In the first position, the moveable portion of the port side of the hull forms a generally upright portion of the port side of the hull, and in the second position, the moveable portion forms a generally horizontal deck surface that is configured to support a human weighing at least one hundred pounds. At least a portion of the starboard side of the hull is moveable between a first position and a second position. In the first position, the moveable portion of the starboard side of the hull forms a generally upright portion of the starboard side of the hull and in the second position the moveable portion forms a generally horizontal deck surface that is configured to support a human weighing at least one hundred pounds. The primary seating area includes a transverse seat located in an aft portion of the seating area and transverse to the centerline of the boat. At least a portion of the port walkway is adjacent to the moveable portion of the port side, and at least a portion of the port walkway is adjacent to the transverse seat. At least a portion of the starboard walkway is adjacent to the moveable portion of the starboard side, and at least a portion of the starboard walkway is adjacent to the transverse seat. The removable seat is configured to be positioned adjacent to the transverse seat and over at least one of the port walkway and the starboard walkway.

These and other aspects of the invention will become apparent from the following disclosure.

DETAILED DESCRIPTION OF THE PREFERRED EMBODIMENTS

As used herein, directional terms forward (fore), aft, port, starboard, inboard, and outboard have their commonly understood meaning in the art. Relative to the boat, forward is a direction towards the bow and aft is a direction towards the stern. When facing forward in the boat, port is left and starboard is right. Finally, inboard is a direction toward the center of the boat and outboard is a direction away from the center of the boat.

Figure 1:
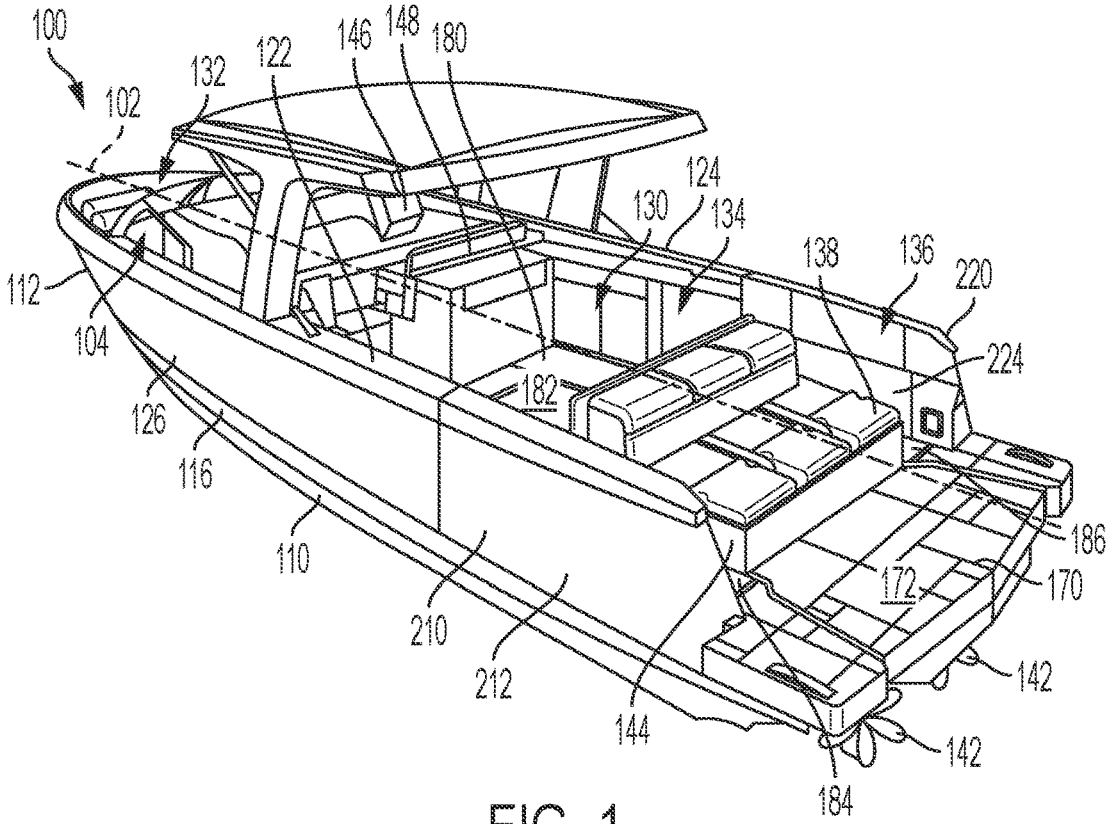
FIG. 1 shows a boat according to a preferred embodiment of the invention.

FIG. 1 shows a boat 100 according to a preferred embodiment of the invention. The boat 100 includes a hull 110 with a bow 112, a transom 114 (see FIG. 3), a port side 116, and a starboard side 118 (see FIG. 3). The port side 116 and the starboard side 118 have a port gunwale 122 and a starboard gunwale 124, respectively. The boat 100 has a centerline 102 running down the middle of the boat 100, halfway between the port side 116 and the starboard side 118. Collectively, the bow 112, the transom 114, the port side 116, and the starboard side 118 define an interior 130 of the boat 100.

In the embodiment shown in FIG. 1, the boat 100 is a bowrider having a bow seating area 132 positioned in the bow 112 of the boat 100 and a primary seating area 134 (sometimes also referred to as the cockpit) positioned aft of a windshield 104. Although described in reference to a bowrider, this invention may be used with any suitable boat, including cuddies, center consoles, and cruisers, for example. In addition, the boat 100 includes a stern seating area 136, which includes aft-facing seating 138. Any suitable seating configuration may be used in the stern seating area 136, but in this embodiment, the aft-facing seating 138 is the configuration shown and described in U.S. patent application Ser. No. 16/667,248, which is incorporated by reference herein in its entirety. The stern seating area 136 is in the aft half of the boat 100 and, more preferably, in the aft third of the boat 100.

Figure 3:
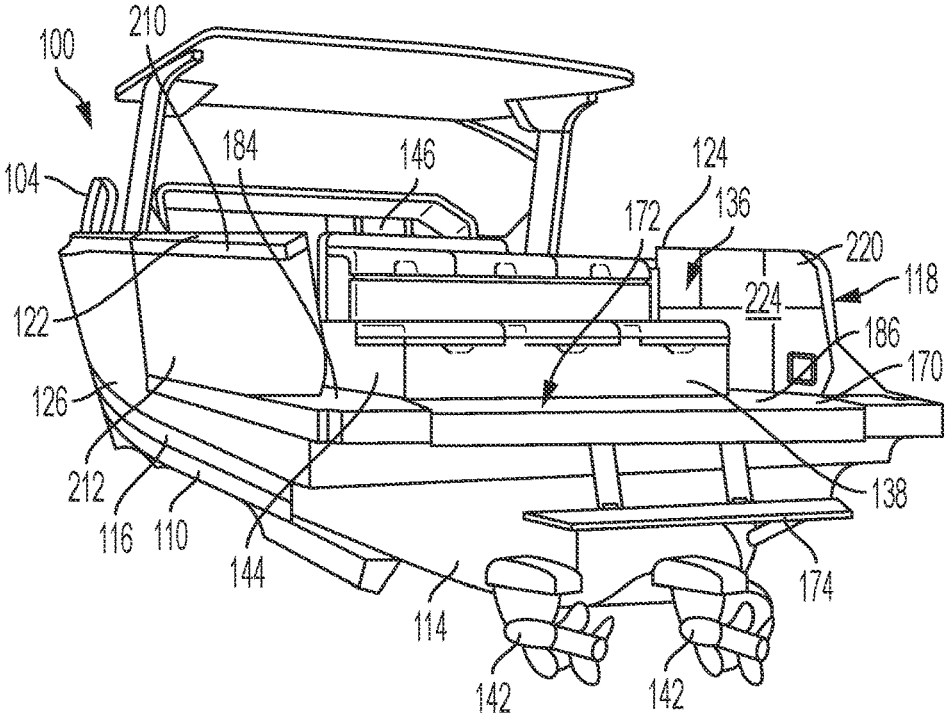
FIG. 3 is a stern view of the boat shown in FIG. 1 with moveable portions of the hull in a raised position.

In this embodiment, the boat 100 is an inboard/outboard (also referred to as a sterndrive) that includes two inboard motors (not shown), each connected to a sterndrive mechanism 142 (see FIG. 3). However, this invention can be utilized with other types of boats and propulsion systems, including but not limited to outboard motors, jet drives, inboards, and the like. The motors are located under a hatch, which is referred to herein as the motor box 144. The aft-facing seating 138 is located on the motor box 144. The boat 100 includes a control console 146 for operating the boat 100. Here, the control console 146 is positioned on the starboard side of the boat 100 proximate to and aft of the windshield 104. A driver's seat 148, which in this embodiment is a bench type seat, is positioned aft of the control console 146.

Figure 4:
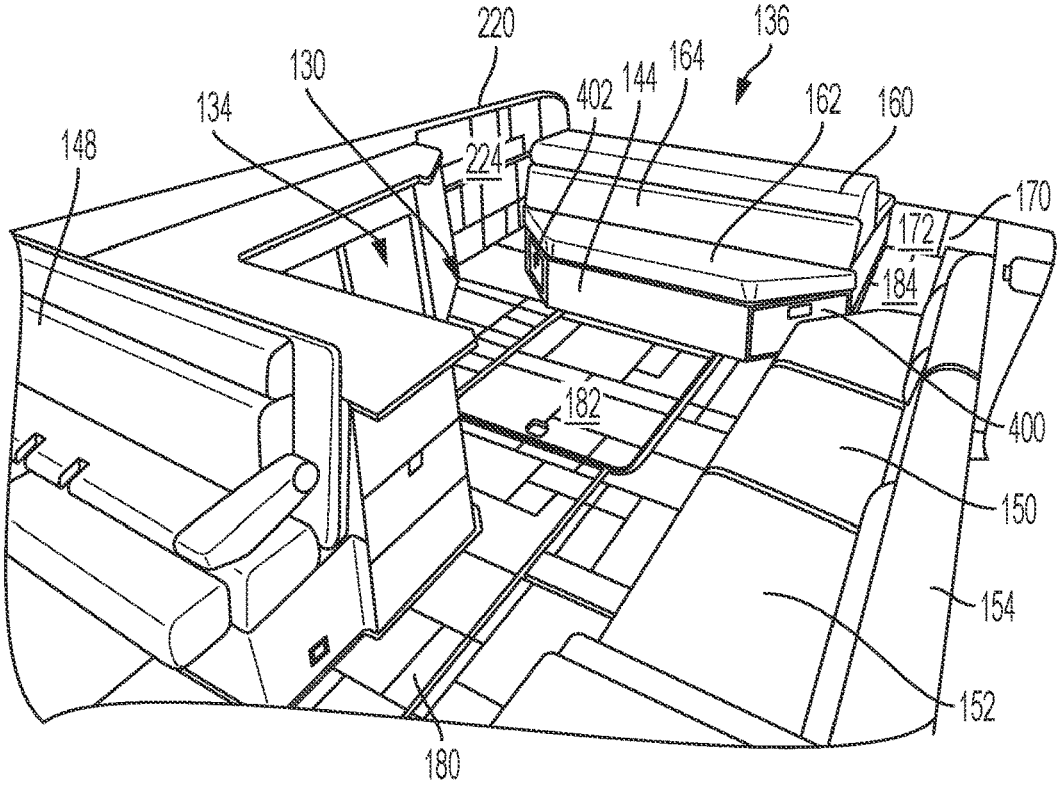
FIG. 4 is a perspective view of a seating area of the boat shown in FIG. 1.

The primary seating area 134 of this embodiment, which is shown in FIG. 4, includes a port-side bench seat 150. The port-side bench seat 150 is located along the port side of the boat 100 and extends in a longitudinal direction of the boat 100, which is generally parallel to the centerline 102 of the boat 100. The port-side bench seat 150 includes a seat bottom 152 and a seat back 154. Each of the seat bottom 152 and the seat back 154 is a cushion. The cushions discussed herein may include a soft but supportive material, such as triple-density foam, that is attached to a structural member, such as a plate or a frame, and covered with a waterproof material, such as premium grade vinyl. In this embodiment, when a person is seated on the port-side bench seat 150 with their back against the seat back 154 and buttocks on the seat bottom 152, they face in starboard direction of the boat 100. The seat bottom 152 is supported by a seat support structure 156. The seat back 154 is supported by an interior surface of the port side 116 of the hull 110.

The primary seating area 134 also includes a transverse seat 160. The transverse seat 160 is a bench seat located in the aft portion of the primary seating area 134 and transverse to the centerline 102 of the boat 100. The transverse seat 160 includes a seat bottom 162 and a seat back 164, each of which is a cushion. The seat support structure for the transverse seat 160 is the motor box 144 in this embodiment. In this embodiment, when a person is seated on the transverse seat 160 with their back against the seat back 164 and buttocks on the seat bottom 162, they face forward. Although the primary seating area 134 is described as having two bench seats, the port-side bench seat 150 and the transverse seat 160, the primary seating area 134 may have any suitable number of seats. For example, instead of having a galley with twin refrigerators, grills, a sink, and cooler storage (under the sink), the primary seating area 134 may also have a starboard-side bench seat, which is symmetrical with the port-side bench seat 150.

Figure 2:
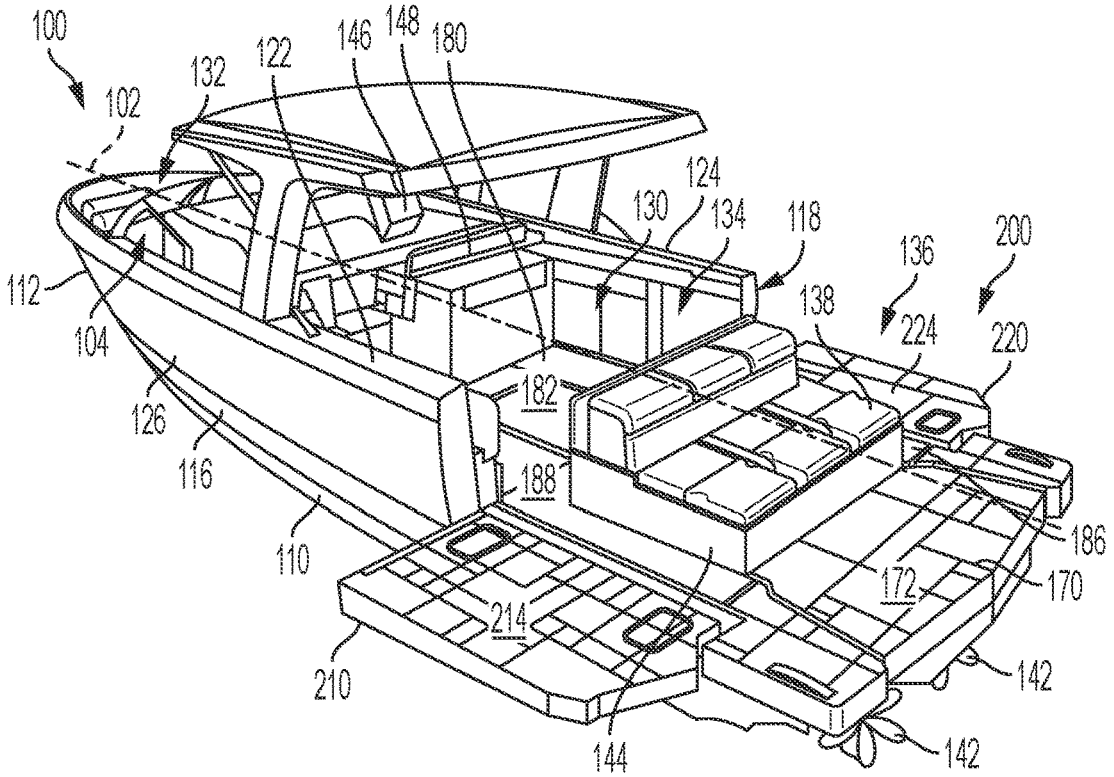
FIG. 2 is a perspective view of the boat shown in FIG. 1 with moveable portions of the hull in a lowered position.

The boat 100 also includes a reboarding platform 170, which is sometimes also referred to as a swim platform, as shown in FIG. 1-3. The reboarding platform 170 includes an upper surface 172. The reboarding platform 170, and in particular the upper surface 172, is generally horizontal. The reboarding platform 170 extends aft from the boat 100 and may be used to help people get in and out of the water. The reboarding platform 170 may include a ladder (not shown) that can be stowed in or underneath the reboarding platform 170 to assist with this purpose or it may include a hydraulically deployable swim step 174 (see FIG. 3). The reboarding platform 170 of this embodiment is formed integrally with the hull 110 of the boat 100 and positioned above the transom 114. The invention described herein is not limited to integral reboarding platforms. The invention may also be used on boats having, for example, a separate platform attached to the transom 114 or even with boats that do not have a reboarding platform 170.

The boat 100 has a deck 180 which includes a floor 182 of the primary seating area 134. In this embodiment, the upper surface 172 of the reboarding platform 170 is connected to the floor 182 by a port-side walkway 184 and a starboard-side walkway 186. The walkways may also be referred to as walk-throughs. In this embodiment, the floor 182, upper surface 172 of the reboarding platform 170, port-side walkway 184, and starboard-side walkway 186 are all at the same level, forming a generally flat, horizontal, and continuous surface on which a person can walk. The deck 180 also includes elevated portions, which are elevated with respect to the floor 182. The elevated portions of the deck 180 include, for example, support for the control console 146 and the seat support structure 156 for the port-side bench seat 150. In other embodiments, the seat support structure for the transverse seat 160 also may be an elevated portion of the deck 180 instead of the motor box 144.

The boat 100 of this embodiment has a stern deck that may be expanded to form an expanded stern deck 200. The boat 100 of this embodiment thus has an expandable stern deck. In this embodiment, a portion of the port side 116 of the hull 110 is moveable between a first position and a second position (a port-side moveable portion 210), and a portion of at the starboard side 118 of the hull 110 is moveable between a first position and a second position (a starboard-side moveable portion 220). FIGS. 1 and 3 show each of the port-side moveable portion 210 and the starboard-side moveable portion 220 in the first position, and FIG. 2 shows each of the port-side moveable portion 210 and the starboard-side moveable portion 220 in the second position. In this embodiment, the port-side moveable portion 210 and the starboard-side moveable portion 220 are symmetrical and have a similar configuration such that the description of one of the port-side moveable portion 210 and the starboard-side moveable portion 220 also applies to the other one.

In this embodiment, each of the port-side moveable portion 210 and the starboard-side moveable portion 220 forms a generally upright portion of the port side 116 of the hull 110 and the starboard side 118 of the hull 110, respectively, when in the first position. As can be seen in FIG. 3, for example, an exterior surface 212 of the port-side moveable portion 210 forms a continuous surface of an exterior surface 126 of the port side 116 of the hull 110. An interior surface 214 of the port-side moveable portion 210 is also upright and, in this embodiment, is generally vertical such that it is generally orthogonal to the port-side walkway 184. The orientation of the interior surface 214 of the port-side moveable portion 210 in the first position is not so limited and deviations from vertical are contemplated to be within the scope of the invention.

The port-side moveable portion 210 and the starboard-side moveable portion 220 of this embodiment are each located in the aft third of the boat 100, and in this embodiment start at the forward-most portion of the motor box 144. The port-side walkway 184 is located between the motor box 144 and the port-side moveable portion 210, and the starboard-side walkway 186 is located between the motor box 144 and the starboard-side moveable portion 220. In the second position, the interior surface 214 of the port-side moveable portion 210 is an upper surface, which forms a generally horizontal deck surface. Likewise, the interior surface 224 of the starboard-side moveable portion 220 is also an upper surface in the second position forming a generally horizontal deck surface. In the second position shown in this preferred embodiment, each of the interior surfaces (upper surfaces) 214, 224 of the port-side moveable portion 210 and the starboard-side moveable portion 220 forms a continuous deck surface with the adjacent walkway (port-side walkway 184 and starboard-side walkway 186, respectively), although the invention is not so limited. With either of the port-side moveable portion 210 and the starboard-side moveable portion 220 in the second position, the boat 100 has an expanded stern deck 200.

In this embodiment, the port-side moveable portion 210 and the starboard-side moveable portion 220 are rotatable and rotate between the first position and the second position about a pivot axis. The port-side moveable portion 210 and the starboard-side moveable portion 220 are not, however, so limited, and other moveable configurations may be used. For example, the exterior surface 212 of the port-side moveable portion 210 may move in an outboard direction and the deck of the expanded stern deck 200 slides outboard from underneath the port-side walkway 184. Any suitable mechanism may be used to move the port-side moveable portion 210 and the starboard-side moveable portion 220 between the first position and the second position, including for example, a hydraulic system including a hydraulic cylinder and ram.

Because each of the port-side moveable portion 210 and the starboard-side moveable portion 220 is used as a deck surface, they should be designed to support a human on the upper surface (interior surface 214, 224) thereof. Each of the port-side moveable portion 210 and the starboard-side moveable portion 220 is preferably capable of supporting at least about 100 pounds, which is approximately the fifth percentile for female weight. More preferably, each of the port-side moveable portion 210 and the starboard-side moveable portion 220 is capable of supporting at least 500 pounds and even more preferably 1,250 pounds.

The expanded stern deck 200 may be particularly useful when the boat is stationary, allowing for increased access to the water off the stern of the boat and increasing the areas for the occupants to move about. As discussed above, the port-side walkway 184 and the starboard-side walkway 186 facilitate access to the expanded stern deck 200, including the reboarding platform 170, and thus connect the floor 182 of the primary seating area 134 with the expanded stern deck 200. Although this is beneficial when the boat 100 is stationary, the port-side walkway 184 and the starboard-side walkway 186 limit the seating capacity of the primary seating area 134. The boat 100 of this embodiment thus includes a removable seat 300 which can be positioned over the port-side walkway 184. Although shown and described with the removable seat 300 over the port-side walkway 184, the removable seat 300 may also be located over the starboard-side walkway 186 or other similar walkway within the boat 100.

FIG. 4 shows the primary seating area 134 with the removable seat 300 removed and the port-side walkway 184 open, allowing access to the expandable stern deck 200. The port-side moveable portion 210 is shown in the second position in FIG. 4. The removable seat 300 is also removed in FIG. 2. As can be seen in FIGS. 2 and 4, each of the port-side bench seat 150 and the transverse seat 160 are located adjacent to a forward portion 188 of the port-side walkway 184. The aft end of the port-side bench seat 150 and the port end of the transverse seat 160 are each at an oblique angle relative to the centerline 102 of the boat, and the port-side walkway 184, particularly the forward portion 188, passes therebetween.

Figure 5:
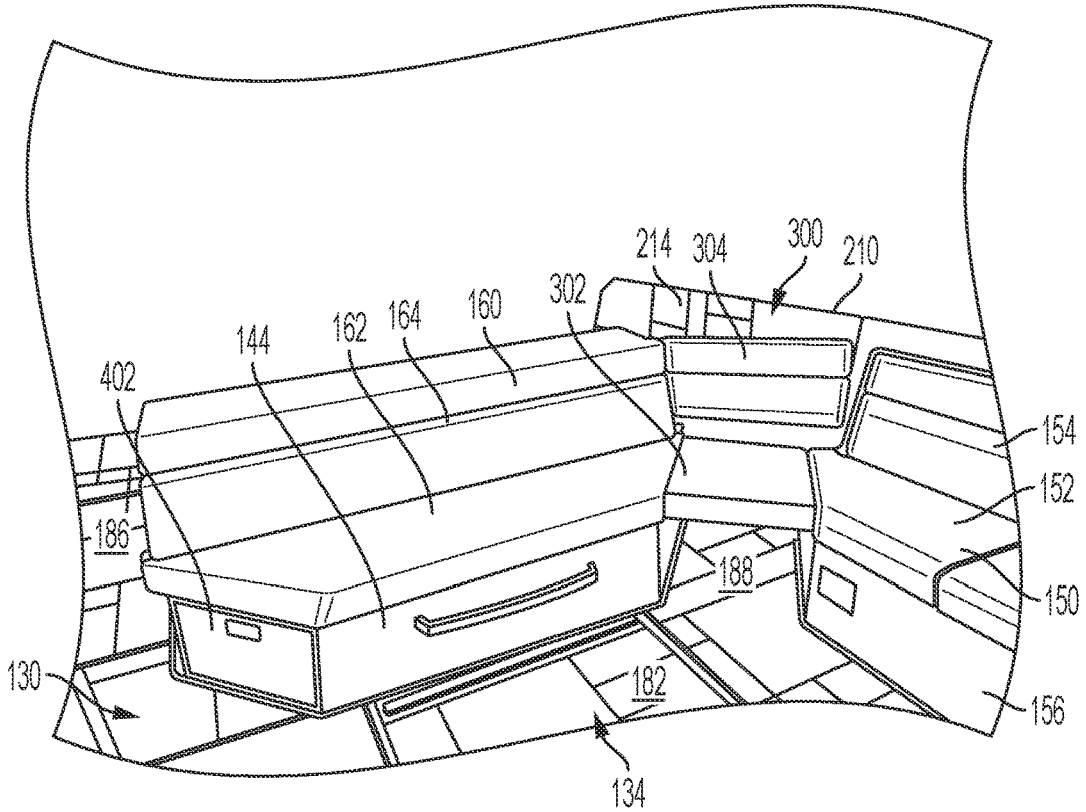
FIG. 5 shows a removable seat configured to be positioned over a walkway.
Figure 6:
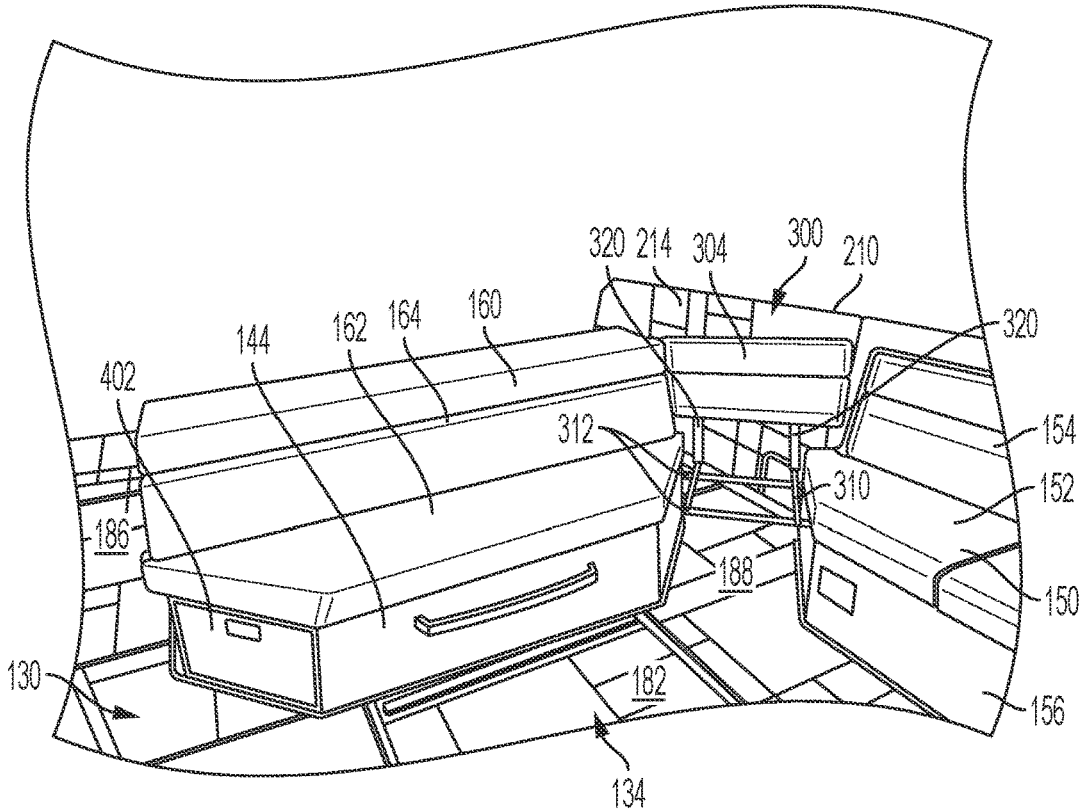
FIG. 6 is the view of FIG. 5 with the seat bottom cushion of the removable seat removed.
Figure 7:
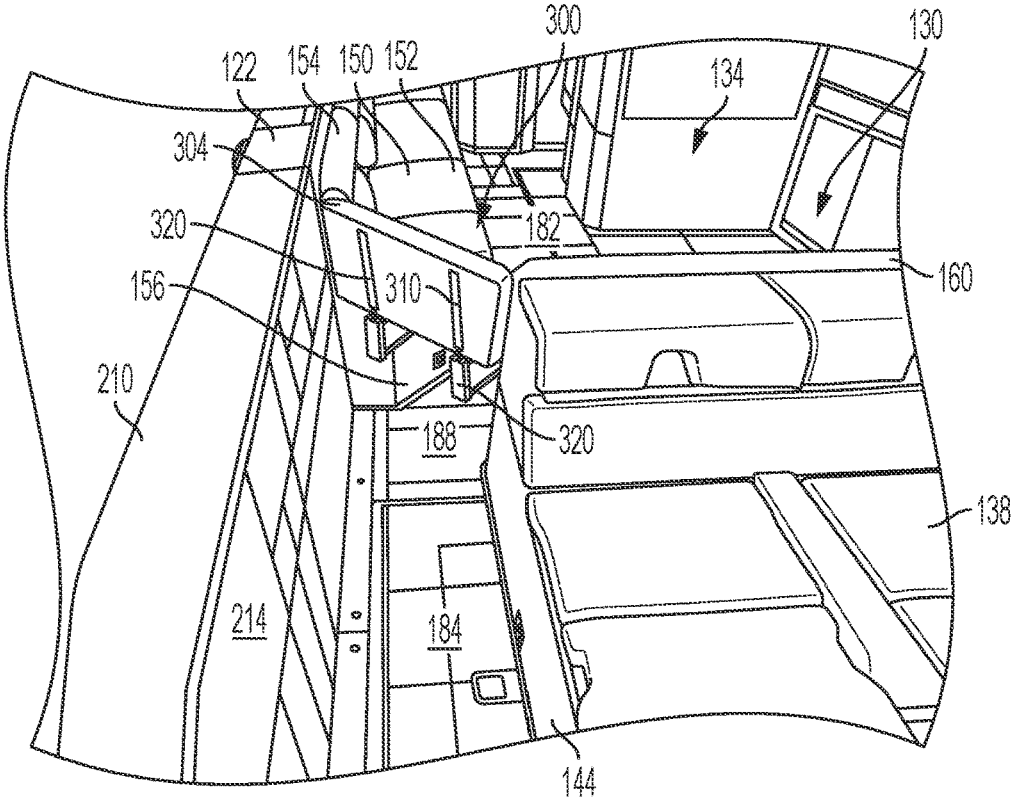
FIG. 7 shows the back side of the removable seat shown in FIG. 6.

FIGS. 5 and 6 show the removable seat 300 installed, with a seat bottom 302 of the removable seat 300 being removed in FIG. 6 for clarity. FIG. 7 is a view looking down the port-side walkway 184 showing the back side of the removable seat 300 (again with the seat bottom 302 of the removable seat 300 removed for clarity). In FIGS. 5, 6, and 7, the port-side moveable portion 210 is in the first position.

When installed, the removable seat 300 is located over the forward portion 188 of the port-side walkway 184. The removable seat 300 thus provides additional seating within the primary seating area 134. As can be seen in FIG. 5, the removable seat 300 includes a seat bottom 302 and a seat back 304, each of which is a cushion. The seat bottom 302 has a rectangular shape and is sized to fit between the angled ends of the seat bottom 152 of the port-side bench seat 150 and seat bottom 162 of the transverse seat 160. The seat bottom 302 together with the seat bottom 152 of the port-side bench seat 150 and seat bottom 162 of the transverse seat 160 form a generally continuous, L-shaped seat. The seat back 304 is similarly positioned between the seat back 154 of the port-side bench seat 150 and the seat back 164 of the transverse seat 160. In this embodiment, when a person is seated on the removable seat 300 with their back against the seat back 304 and buttocks on the seat bottom 302, they face at an angle in both a forward and starboard direction.

The removable seat 300 is configured to be positioned in (or in this embodiment) over the forward portion 188 of the port-side walkway 184 using various suitable configurations. One such configuration includes a frame 310 and is shown in FIGS. 6, 7, and 9-12. In this configuration the seat bottom 302 and the seat back 304 are supported by the frame 310. The frame 310 includes two L-shaped brackets 320 to which the structural member of the cushions of the seat bottom 302 and seat back 304 are attached. The seat bottom 302 and the seat back 304 may be attached to each L-shaped bracket 320 by any suitable means including, for example, screws. In this embodiment, the L-shaped bracket 320 is formed from rectangular bars, but the geometry of the L-shaped bracket 320 is not so limited. Instead, any other suitable configuration and shape may be used for or in lieu of the L-shaped bracket 320, including a beam; a plate; a circular, hollow rod; or the like. Preferably, the removable seat is configured to have a smaller size for storage when not in use, such as the seat back 304 being configured to fold. In this embodiment, each L-shaped bracket 320 also includes a hinge or a pivot mechanism 322 that allows the seat back 304 to fold down in direction A over the seat bottom 302. Any suitable hinge or pivot mechanism may be used.

The portion of the L-shaped bracket 320 supporting the seat bottom 302 is also attached to two cross members 312. Each cross member 312 of this embodiment is a straight, rectangular bar, but like the L-shaped bracket 320, the geometry of the cross member 312 is not so limited. The cross members 312 span the distance between the port-side bench seat 150 and the transverse seat 160 over the forward portion 188 of the port-side walkway 184, and each end of each cross member 312 is supported by the seat support structure 156 or the motor box 144. In this embodiment, one end (a first end 314) of each cross member 312 engages with a receiver 332 that is attached to the motor box 144. The receiver 332 may also be integrally formed in the motor box 144. The end of cross member 312 that engages with the receiver 332 is bent to from an L-shape and a hook 334, the latter of which engages with a corresponding hole formed in the receiver 332 (see FIG. 10 where the aft receiver 332 is omitted to show the hook 334). The other end of each cross member 312 (end without the hook 334) is a second end 316 of the cross member 312. The second end 316 is supported by the seat support structure 156 by resting on an upper surface thereof. In this embodiment, the groove is formed in the seat support structure 156 so that an upper surface of the seat bottom 302 of the removable seat 300 can be at the same level as an upper surface of the seat bottom 152 of the port-side bench seat 150 and the seat bottom 162 of the transverse seat 160. Although described with the receiver 332 attached to the motor box 144 and the second end 316 of the cross member 312 resting on the seat support structure 156, other suitable constructions are within the scope of this invention. For example, and without limitation, the receivers 332 may be attached to the seat support structure 156 instead of or in addition to the motor box 144. To remove the removable seat 300, the user may lift up on the removable seat 300, thereby disengaging the hooks 334 from the receivers 332.

Figure 13:
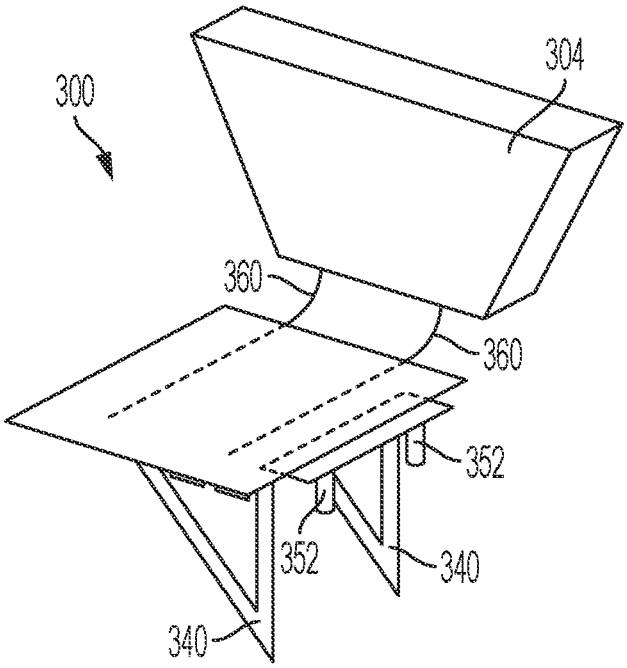
FIG. 13 shows another removable seat configured to be positioned over the walkway.
Figure 14A:
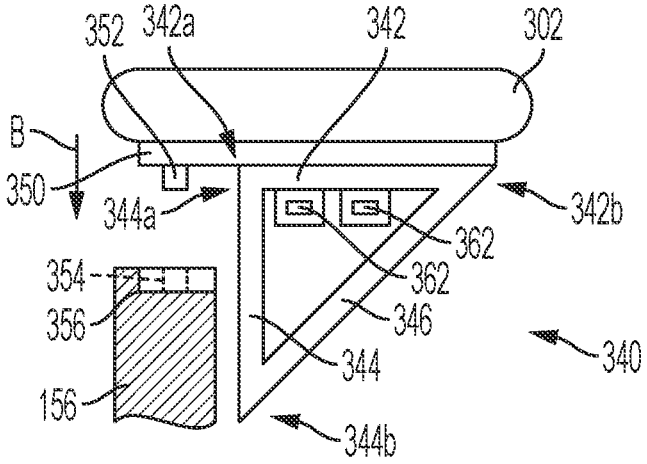
FIG. 14A is a back-side view of a seat bottom of the removable seat shown in FIG. 13.
Figure 14B:
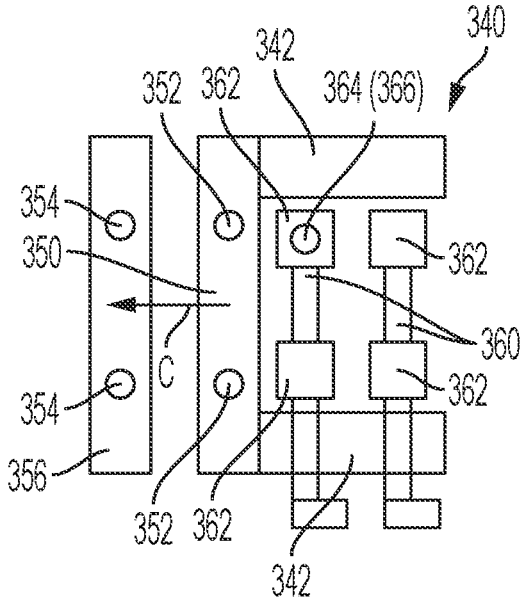
FIG. 14B is a top-side view of the seat bottom shown in FIG. 14A.
Figure 15:
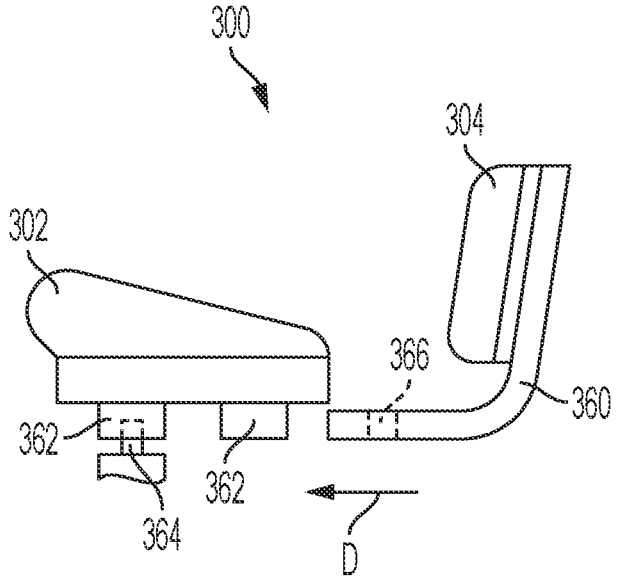
FIG. 15 is a side view of the seat back of the removable seat shown in FIG. 13 being attached to the seat bottom of the removable seat shown in FIG. 13.

FIGS. 13-15 show another suitable configuration of the removable seat 300. FIG. 13 is a perspective view of the removable seat 300 of this embodiment. The cushion of the seat bottom 302 is removed for clarity. FIG. 14A is a back-side view of seat bottom 302, and FIG. 14B is a top-side view of the seat bottom 302. The seat bottom 302 is supported by two seat-bottom brackets 340. The two seat-bottom brackets 340 are spaced apart from each other with one on the front side of the seat bottom 302 and the other on the rear side of the seat bottom 302, but the two seat-bottom brackets 340 may have other suitable positions, such as being spaced apart from each other in a left and right direction of the seat bottom 302.

Each seat-bottom bracket 340 of this embodiment is L-shaped with two legs, a seat-bottom leg 342 and a support leg 344. The seat-bottom leg 342 is connected to the underside of the seat bottom 302, in a manner similar to the L-shaped brackets 320 of the frame 310, discussed above. The seat-bottom leg 342 extends underneath the seat bottom 302 and has a proximal end portion 342*a* and a distal end portion 342*b*. The support leg 344 includes an upper end portion 344*a* and a lower end portion 344*b*. The proximal end portion 342*a* of the seat-bottom leg 342 is attached to the upper end portion 344*a* of the support leg 344 to form the L-shape of the seat-bottom bracket 340, and in this embodiment, the distal end portion 342*b* and the lower end portion 344*b* are connected to each other by a connecting support 346. The connecting support 346 of this embodiment is linear and connects the distal end portion 342*b* and the lower end portion 344*b*, such that the seat-bottom bracket 340 also has a triangular shape. The connecting support 346 is not so limited an may have other shapes and be attached to each of the seat-bottom leg 342 and support leg 344 at a distance spaced from the distal end portion 342*b* and lower end portion 344*b* towards the proximal end portion 342*a* and the upper end portion 344*a*, respectively.

As noted above, the two seat-bottom brackets 340 may be connected to each other by virtue of both being attached to the seat bottom 302, but they may also be connected to each other by other suitable means, including for example, a stay 350. The stay 350 of this embodiment is a flat bar that is attached to the proximal end portion 342*a* of each seat bottom bracket 340, but other suitable geometries and attachment points of the stay 350 may be used. The stay 350 of this embodiment includes two pins 352. Each pin 352 is inserted into a corresponding hole 354 to support and position the removable seat 300. The holes 354 of this embodiment are formed in a support plate 356 that is located on an upper surface of the seat support structure 156. The removable seat 300 of this embodiment is thus supported by the seat support structure 156. Other alternative configurations may be used, for example, the holes 354 may be formed directly in the upper surface of the seat support structure 156 or the support plate 356 may be cantilevered from an upright surface of the seat support structure 156. In addition, the removable seat 300 of this embodiment may be supported by other portions of the interior 130 of the boat 100 that include an upright surface. Such upright surfaces also may include, for example, the motor box 144 or an interior surface of the port side 116 or the starboard side 118 of the hull 110.

To install the removable seat 300, a user positions the seat bottom 302 and the seat back 304 to insert the pins 352 into the holes 354 by moving the seat bottom 302 in the directions indicated by arrows B and C in FIGS. 14A and 14B, respectively. To remove the removable seat 300, the user may lift up on the removable seat 300, thereby disengaging the pins 352 from the holes 354. When installed, the support legs 344 are oriented parallel to the upright surface of the seat support structure 156 and distribute some of the load (weight) placed on the seat bottom 302, such as from a person seated in the removable seat 300, to the upright surface.

The seat back 304 of this embodiment is removable separately from the seat bottom 302. FIG. 15 is a side view of the seat back 304 being attached to the seat bottom 302, and together with FIGS. 14A and 14B, show the features used to connect the seat back 304 with the seat bottom 302. Two seat-back brackets 360 are used to support the seat back 304. Each seat-back bracket 360 of this embodiment is L-shaped and is similar to the L-shaped bracket 320 of the frame 310, discussed above, except the seat-back bracket 360 does not include a pivot mechanism 322. One leg of the seat-back bracket 360 is connected to the seat back 304 and the other leg engages with a receiver 362 formed on the seat bottom 302. In this embodiment, a plurality of receivers 362 are attached to the underside of the seat bottom 302. In this embodiment, two receivers 362 are used for each seat-back bracket 360 and each receiver 362 is attached to the seat bottom 302. Other suitable numbers of receivers 362 may be used, such as one for each seat-back bracket 360, and the receiver 362 may be formed or connected to the seat bottom 302 in other ways such as being attached to the seat-bottom leg 342 of the seat bottom bracket 340.

To attach the seat back 304 to the seat bottom 302, each seat-back bracket 360 slides into corresponding receivers 362 in the direction indicated by the arrow D in FIG. 15. At least one of the receivers 362 includes a pin 364 that engages with a hole 366 formed in the seat-back bracket 360 to lock the seat back 304 in place. The pin 364 may include a spring that urges the pin 364 upward to keep the pin 364 engaged with the hole 366. To remove the seat back 304, the user pulls the pin 364 downward to disengage the pin 364 from the hole 366 in the seat-back bracket 360, and then pulls the seat back 304 and seat-back bracket 360 in a direction opposite to direction D to slide the seat-back bracket 360 out of the receivers 362. The seat bottom 302 of this embodiment can be used alone or with the seat back 304, and removing the seat back 304 allows the removable seat 300 have a smaller size when stored.

Figure 8:
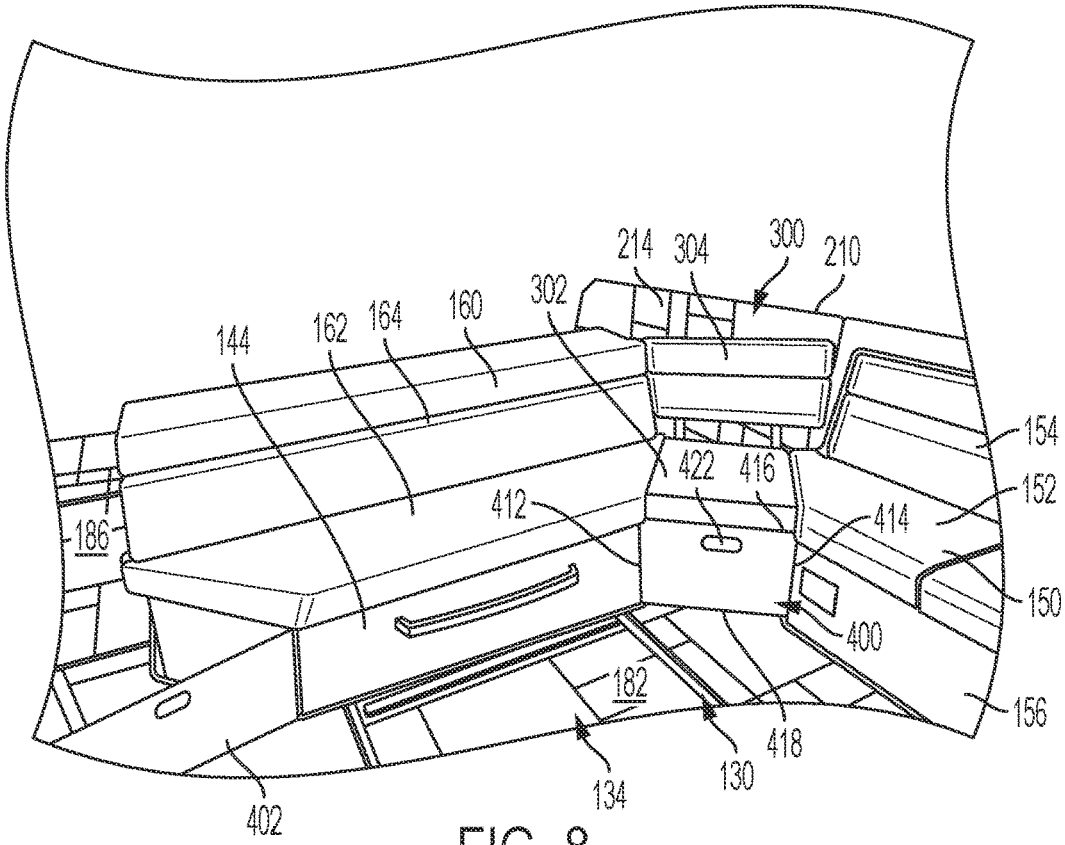
FIG. 8 is the view of FIG. 5 with both a port-side and a starboard-side walkway door in a closed position.
Figure 9:
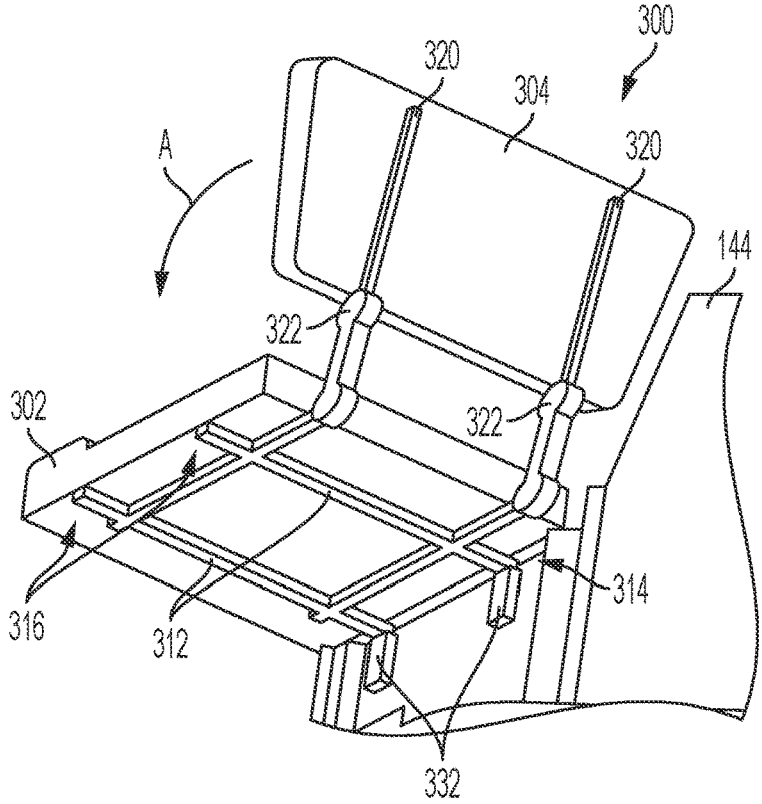
FIG. 9 shows the underside of the removable seat shown in FIG. 5.
Figure 10:
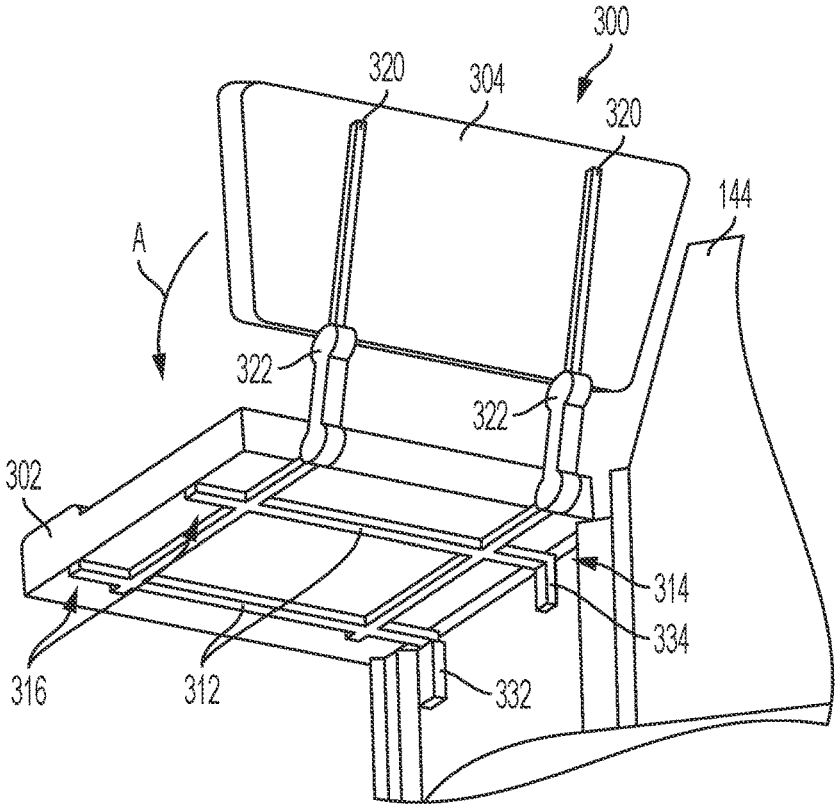
FIG. 10 is the view of FIG. 9 with a receiver removed.
Figure 11:
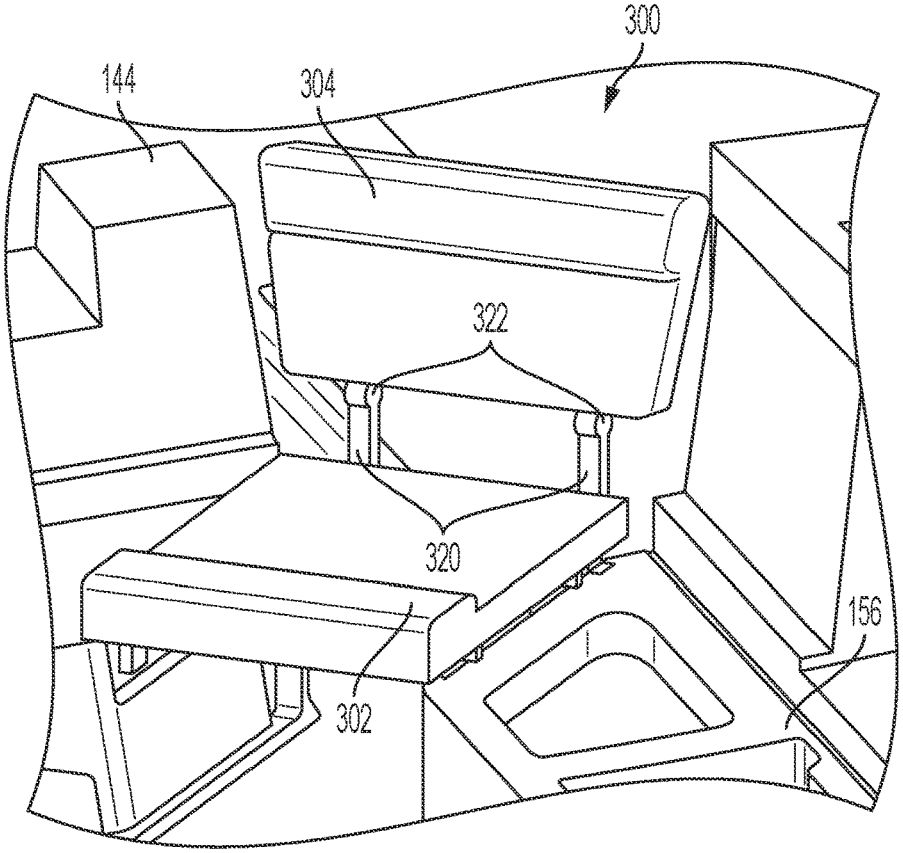
FIG. 11 is another view of the removable seat shown in FIG. 5 with seat bottoms of a port-side bench seat and transverse seat removed.
Figure 12:
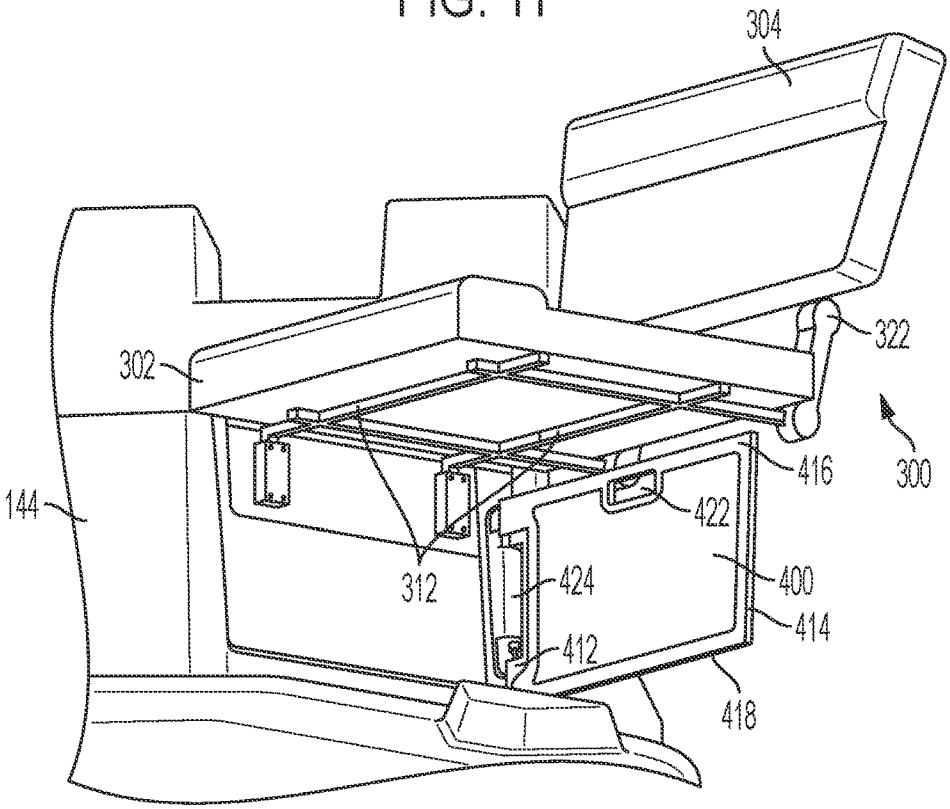
FIG. 12 is another view of the underside of the removable seat shown in FIG. 5 with a port-side walkway door in a closed position.

The boat 100 of this embodiment also includes a port-side walkway door 400 and a starboard-side walkway door 402, each moveable between a closed position and an open position. FIG. 8 shows the port-side walkway door 400 and the starboard-side walkway door 402 in the closed position, and the other figures show the port-side walkway door 400 and the starboard-side walkway door 402 in the open position. The starboard-side walkway door 402 is the same as the port-side walkway door 400 in this embodiment, and the description of the port-side walkway door 400 also applies to the starboard-side walkway door 402. The port-side walkway door 400 is used to close the port-side walkway 184 to prevent people, particularly children, pets, or objects from moving from the primary seating area 134 into the port-side walkway 184.

The port-side walkway door 400 is a plate-like structure that is sized to span the opening (forward portion 188 of the port-side walkway 184) between the port-side bench seat 150 and the motor box 144. The port-side walkway door 400 may be any material suitable for the marine environment, including for example, plastic, fiberglass, metal billet, and combinations of the same. The port-side walkway door 400 is pivotably attached along its inboard edge 412 to the motor box 144 using a pivot mechanism 424 (see FIG. 12). The port-side walkway door 400 also includes an elongated slot 422 in an upper portion thereof. The elongated slot 422 is preferably sized to fit the hand of the user and allow the user to move the port-side walkway door 400 between the open position and the closed position. Although described as being pivotably connected along the inboard edge 412 the port-side walkway door 400 may be configured to be pivotably connected along an outboard edge 414. Any suitable pivot mechanism 424 may be used. In this embodiment, the pivot mechanism 424 locks the port-side walkway door 400 in its open or closed position. A user lifts up on the port-side walkway door 400 using the elongated slot 422 and the pivot mechanism 424 allows the port-side walkway door 400 to pivot. A user then moves the port-side walkway door 400 to either its open or closed position and releases the elongated slot 422, allowing the port-side walkway door 400 to lower, and the pivot mechanism 424 locks the port-side walkway door 400 in position.

In this embodiment, the cross members 312 of the removable seat 300 are engaged with the seat support structure 156 and the motor box 144 at an upper portion thereof and just under the seat bottom 152 of the port-side bench seat 150 and the seat bottom 162 of the transverse seat 160. The port-side walkway door 400 is under the removable seat 300 and is sized such that it does not interfere with the cross members 312. Thus, the port-side walkway door 400 can rotate between the open position and the closed position without contacting the cross member 312, and the top edge 416 of the port-side walkway door 400 is lower than the cross members 312. The port-side walkway door 400 is also preferably sized such that the bottom edge 418 is close to the floor 182 and minimizes the objects that can roll or slide under it.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a hull including a bow, a transom, a port side, and a starboard side, at least a portion of at least one of the port side and the starboard side of the hull being moveable between a first position and a second position, wherein in the first position the moveable portion forms a generally upright portion of the port or starboard side of the hull and in the second position the moveable portion forms a generally horizontal deck surface that is configured to support a human weighing at least one hundred pounds;

a seating area within the boat;

a walkway connecting the seating area to an area aft of the seating area, at least a portion of the walkway being adjacent to the moveable portion of the port or starboard side;

a first seat within the seating area, the first seat being positioned adjacent to at least a portion of the walkway; and a removable seat configured to be positioned over the walkway and adjacent to the first seat.

2. The boat of claim 1, wherein the moveable portion is pivotable about a pivot axis to move between the first position and the second position.

3. The boat of claim 2, wherein the moveable portion includes an upper surface that (i) forms the generally horizontal deck surface when the moveable portion is in the second position and (ii) is an inner surface of the moveable portion when the moveable portion is in the first position.

4. The boat of claim 1, wherein, when the moveable portion is in the second position, the generally horizontal deck surface and the walkway are a continuous deck surface.

5. The boat of claim 1, further comprising a reboarding platform, the walkway connecting the seating area with the reboarding platform.

6. The boat of claim 1, wherein the first seat includes a seat support structure.

7. The boat of claim 6, wherein the seat support structure is a hatch.

8. The boat of claim 1, further comprising a second seat, a portion of the walkway being between the first seat and the second seat, the removable seat being located over the portion of the walkway between the first seat and the second seat.

9. The boat of claim 8, wherein each of the first seat, the second seat, and the removable seat includes a seat bottom, each of the seat bottoms of the first seat, the second seat, and the removable seat forming a continuous seat.

10. The boat of claim 8, wherein each of the first seat and the second seat includes a seat support structure.

11. The boat of claim 10, wherein the removable seat is supported by the seat support structure of the first seat and the seat support structure of the second seat.

12. The boat of claim 10, further comprising a door, the door being pivotably attached to one of the seat support structure of the first seat and the seat support structure of the second seat, the door being moveable between a closed position and an open position, and, in the closed position, the door is positioned under the removable seat.

13. The boat of claim 12, wherein the door, in the closed position, is sized to span the portion of the walkway between the first seat and the second seat.

14. A boat comprising:

a hull including a bow, a transom, a port side, and a starboard side, at least a portion of the port side of the hull being moveable between a first position and a second position, wherein in the first position the moveable portion forms a generally upright portion of the port side of the hull and in the second position the moveable portion forms a generally horizontal deck surface that is configured to support a human weighing at least one hundred pounds, at least a portion of the starboard side of the hull being moveable between a first position and a second position, wherein in the first position the moveable portion forms a generally upright portion of the starboard side of the hull and in the second position the moveable portion forms a generally horizontal deck surface that is configured to support a human weighing at least one hundred pounds;

a seating area within the boat, the seating area including a transverse seat located in an aft portion of the seating area and transverse to the centerline of the boat;

a port walkway connecting the seating area to an area aft of the seating area, at least a portion of the port walkway being adjacent to the moveable portion of the port side, and at least a portion of the port walkway being adjacent to the transverse seat;

a starboard walkway connecting the seating area to the area aft of the seating area, at least a portion of the starboard walkway being adjacent to the moveable portion of the starboard side, and at least a portion of the starboard walkway being adjacent to the transverse seat; and a removable seat configured to be positioned adjacent to the transverse seat and over at least one of the port walkway and the starboard walkway.

15. The boat of claim 14, wherein the moveable portion of each of the port side of the hull and the starboard side of the hull is pivotable about a pivot axis to move between the first position and the second position.

16. The boat of claim 15, wherein the moveable portion of each of the port side of the hull and the starboard side of the hull includes an upper surface that (i) forms the generally horizontal deck surface when the moveable portion is in the second position and (ii) is an inner surface of the moveable portion when the moveable portion is in the first position.

17. The boat of claim 14, wherein, when the moveable portion of the port side of the hull is in the second position, the generally horizontal deck surface and the port walkway are a continuous deck surface, and wherein, when the moveable portion of the starboard side of the hull is in the second position, the generally horizontal deck surface and the starboard walkway are a continuous deck surface.

18. The boat of claim 14, further comprising a reboarding platform, the port walkway and the starboard walkway connecting the seating area with the reboarding platform.

19. The boat of claim 14, further comprising an aft-facing seat positioned between the port walkway and the starboard walkway.

* * * * *